US009611575B2

(12) United States Patent
Maparu et al.

(10) Patent No.: US 9,611,575 B2
(45) Date of Patent: Apr. 4, 2017

(54) COATING APPARATUS

(71) Applicant: Tata Consultancy Services Limited, Mumbai (IN)

(72) Inventors: Auhin Kumar Maparu, Pune (IN); Beena Rai, Pune (IN)

(73) Assignee: Tata Consultancy Services Limited (IN)

( * ) Notice: Subject to any disclaimer, the term of this patent is extended or adjusted under 35 U.S.C. 154(b) by 143 days.

(21) Appl. No.: 14/202,711

(22) Filed: Mar. 10, 2014

(65) Prior Publication Data

US 2014/0290570 A1 Oct. 2, 2014

(30) Foreign Application Priority Data

Mar. 28, 2013 (IN) ..... 1209/MUM/2013

(51) Int. Cl.
*D06B 1/14* (2006.01)
*B05C 9/14* (2006.01)
*B05C 11/04* (2006.01)

(52) U.S. Cl.
CPC ..... *D06B 1/14* (2013.01); *B05C 11/04* (2013.01); *B05C 9/14* (2013.01); *B05C 11/045* (2013.01)

(58) Field of Classification Search
CPC ..... B05C 11/04; B05C 11/045; B05C 9/14; D06B 1/14
USPC ..... 118/66, 62, 63, 249, 261, 262, 696, 712; 427/356, 357, 358
See application file for complete search history.

(56) References Cited

U.S. PATENT DOCUMENTS 2,780,563 A * 2/1957 Frost ..... D21G 9/009 118/60
3,288,632 A * 11/1966 Rush ..... B32B 27/00 427/211
4,279,949 A * 7/1981 Esser ..... B05C 11/023 118/126
4,354,810 A * 10/1982 Stidham ..... B05D 1/40 118/102
5,036,793 A * 8/1991 Fraser ..... B05C 11/04 118/126
5,447,566 A * 9/1995 Loiacono ..... B05C 1/083 101/220

(Continued)

FOREIGN PATENT DOCUMENTS

EP 2105690 A2 9/2009
EP 2412537 B1 9/2013
KR 20050063279 A 6/2005

OTHER PUBLICATIONS

"Inline coating"—Koenig & Bauer AG Wurzburg Facility; Issue: 1; 2007, 59 pages, http://www.kba.com/fileadmin/user_upload/KBA_Prozess/prozess_4_e.pdf.

(Continued)

*Primary Examiner* — Laura Edwards
(74) *Attorney, Agent, or Firm* — Finnegan, Henderson, Farabow, Garrett & Dunner, L.L.P.

(57) ABSTRACT

Disclosed is a method for producing a coated substrate using a compact, easy to handle and automated coating apparatus that can prepare coated composite in a single batch process, with sufficient control over each portion of the coating apparatus. The coating apparatus may include a coating unit, a drying unit and a pressing unit sequentially arranged in a single line to produce the coated substrate.

15 Claims, 6 Drawing Sheets

(56) References Cited

U.S. PATENT DOCUMENTS

| | | | | |
|---|---|---|---|---|
| 6,381,874 | B1 * | 5/2002 | Floyd | D06F 58/04 34/250 |
| 7,669,547 | B2 * | 3/2010 | Jacobson | B05C 1/02 118/203 |
| 2001/0038882 | A1 * | 11/2001 | Onishi | B41F 15/42 427/8 |
| 2005/0214453 | A1 * | 9/2005 | Kawanishi | G02B 1/12 427/163.2 |
| 2006/0147637 | A1 * | 7/2006 | Cooprider | B05C 1/0817 427/355 |
| 2006/0231021 | A1 * | 10/2006 | Friske | B05C 11/041 118/261 |
| 2008/0122129 | A1 * | 5/2008 | Koivukunnas | B29C 59/026 264/1.34 |

OTHER PUBLICATIONS

Wedel, L. G. & Jayaraman, M., "Paper Dryer Doctoring," 2009 Kadant Web Systems Inc., 17 pages.

"Technical Description DT Laboratory Coater," Kaltec Scientific, Inc., 11 pages, http://www.kaltecsci.com/Lab%20Coater.pdf.

"MagnoRoll (coating dyeing finishing system)," Zimmer Austria, 2007, 16 pages, http://www.zimmer-austria.com/cms/data/46/500.pdf.

* cited by examiner

COATING APPARATUS

CROSS-REFERENCE TO RELATED PATENT APPLICATIONS

This application claims priority under 35 U.S.C. §119 to Indian Patent Application No. 1209/MUM/2013, filed on Mar. 28, 2013 in the Indian Patent Office. The entire contents of the above-referenced application are incorporated herein by reference.

TECHNICAL FIELD

The present subject matter described herein, in general, relates to a coating apparatus and a coating method, and more particularly to a coating apparatus and a method for preparing a coated substrate in a single batch.

BACKGROUND

For developing a composite fabric at various locations, such as laboratories, the usual steps involved are coating, drying and finally pressing to improve adhesion of coating. All the stated steps of coating, drying and pressing are generally performed separately. This increases the operation time, makes the process complex with more involvement of manual efforts thereby leading to less reproducibility due to unavoidable manual errors. In addition, for some applications, these three steps need to be executed in quick succession to avoid the coating formulation from drying up. Thus, there may be a need to design and fabricate a compact coating unit with all these features arranged sequentially such that the entire assembly can be accommodated in the laboratory settings. It may be desirable for the coating assembly to have digital/mechanical control over each of its portion as opposed to the manual control that is most commonly observed in the existing lab coating machines.

Various kinds of industrial knife coating machines are mentioned in different literature reports. However, for all the devices mentioned above, the coating processes are complex requiring several units arranged in series, which eventually occupies a lot of space. Such machines may, therefore, not be suitable for small/lab scale applications.

SUMMARY

This summary is provided to introduce aspects related to a coating apparatus that is capable of preparing coated composites in a single process, and the aspects are further described below in the detailed description. While the aspects of the present disclosure contemplates using the coating apparatus, as disclosed herein at the laboratory scale, the apparatus can nevertheless be employed at industrial or commercial scales, as will be apparent to those skilled in the art from the disclosure here-below. This summary is not intended to identify essential features of the claimed subject matter nor is it intended for use in determining or limiting the scope of the claimed subject matter.

An exemplary point-of-use coating apparatus may include a coating unit, wherein the coating unit comprises a coating roller and a knife to apply coating onto a substrate. The point-of-use coating apparatus may further include a drying unit placed downstream with respect to the coating unit, wherein the drying unit may include an insulated chamber for drying the coating applied on the substrate. The point-of-use coating apparatus may further include a pressing unit placed downstream with respect to the drying unit, wherein the pressing unit includes a pair of pressing rolls configured to press the substrate. The point-of-use coating apparatus may further include a control unit for controlling operations of the coating unit, drying unit, and the pressing unit.

BRIEF DESCRIPTION OF THE DRAWINGS

The foregoing summary, as well as the following detailed description of preferred embodiments, is better understood when read in conjunction with the appended drawings. For the purpose of illustrating aspects of the disclosure, there is shown in the drawings example constructions of aspects of the disclosure; however, the aspects of the disclosure are not limited to the specific coating apparatus disclosed in the drawings. In the drawings, the left-most digit(s) of a reference number identifies the drawings in which the reference number first appears. The same numbers are used throughout the drawings to refer to like features and components.

DETAILED DESCRIPTION

Figure 1:
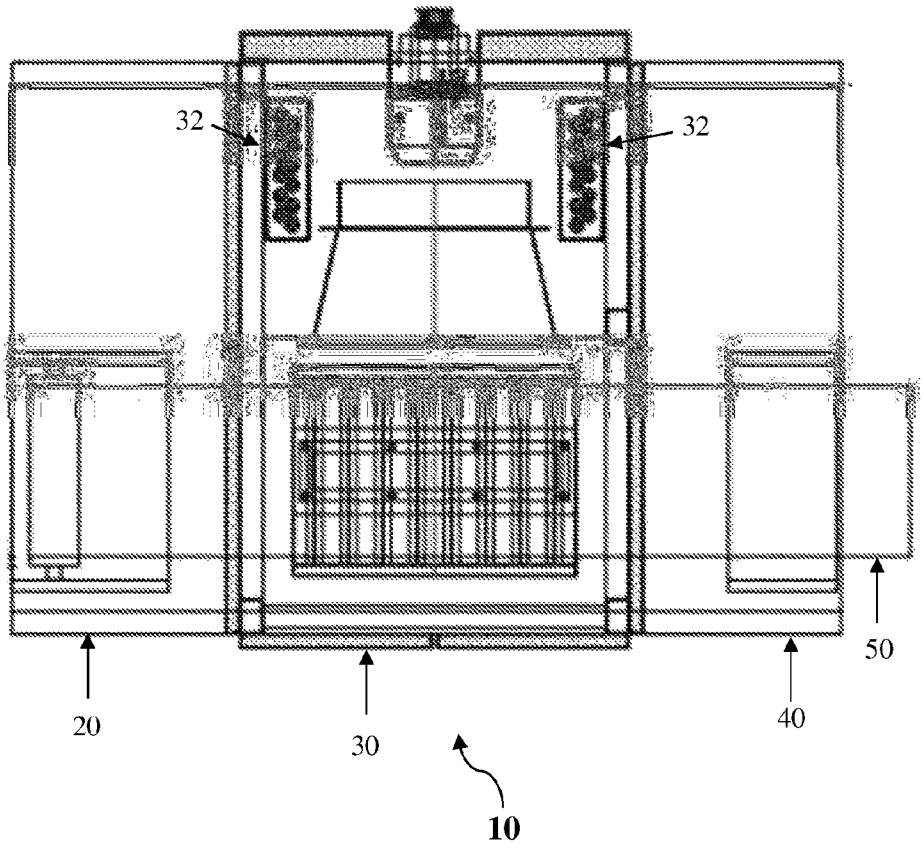
FIG. 1 shows a top plan view of the coating apparatus, in accordance with an embodiment of the present disclosure.

Some embodiments of this disclosure, illustrating all its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present disclosure, the preferred, systems and methods are now described.

The present disclosure is not to be limited in scope by the specific embodiments described herein, since such embodiments are intended as but single illustrations of one aspect of the disclosure and any functionally equivalent embodiments are within the scope of this disclosure. While the embodiments h mention employing of the coating apparatus at laboratory settings, indeed, various modifications to the apparatus to employ at the progressive industrial level, in addition to those shown and described herein will become apparent to those skilled in the art from the foregoing description.

Broadly, the coating apparatus, disclosed herein, may include a coating unit, a drying unit and a pressing unit. The coating unit may include a knife coater further comprising of a knife, wherein said knife may be selected based on the type of coating desired on the substrate. The drying unit may include a dryer with a hot air blower, and the pressing unit may include a pair of pressing rolls, according to one general embodiment of the present subject matter.

In one embodiment, the presently disclosed subject matter may be directed to a portable point-of-use apparatus for production of a coated substrate on a laboratory scale, or commercial or industrial or pilot scale. The "substrate" may be constructed of plastic, synthetic polymers or fabric, and may be of any size and shape known in the art. The substrate treated according to aspects of the disclosure may vary substantially as to conformation and the flexibility employed. Illustratively, the apparatus herein described may utilize a substrate preferably selected from a class of nylons, polyesters, polyamides or aramids.

An exemplary advantage of the coated substrates is that they may be used for protective applications, for example for prevention against lethal chemical warfare agents over an extended period of time and under extremes of environmental attrition not attainable heretofore. Furthermore, the present coating apparatus may be used for developing a polymeric film on a substrate and also, for preparing a sandwich structured composite (e.g. a composite comprising of a metallized polyester film with substrate).

According to an embodiment, a coated substrate may be automatically produced in a single batch process at a laboratory scale. The coating apparatus engaged for producing such a coated substrate may work efficiently in a laboratory environment without occupying much space with good control over each part of the apparatus. The coating apparatus may be capable of laying a film-on substrate and even filling the pores of the substrate; drying it at desired temperature for a specified time and eventually pressing the substrate at a suitable pressure to improve the adhesion of coating. In addition, the coating apparatus, as described herein, may be capable of monitoring and controlling various coating parameters while preparing the composite, not attainable by known coating apparatuses heretofore.

Figure 2:
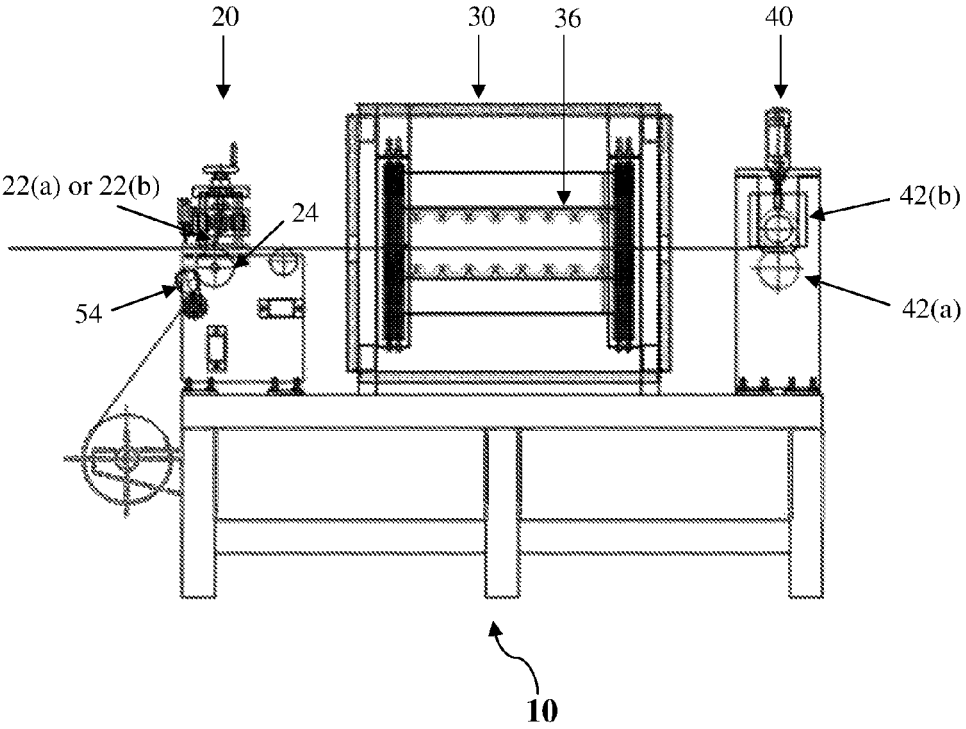
FIG. 2 shows a side view of the coating apparatus, in accordance with an embodiment of the present disclosure.

Referring now to FIGS. 1 & 2, a top view and the side view of a coating apparatus 10 is illustrated, in accordance with an embodiment of the present subject matter. In one embodiment, the disclosure contemplates a portable, point-of-use coating apparatus 10 and method of its use as described herein. In a preferred embodiment, the coating apparatus 10 may include a coating unit 20, a drying unit 30 and a pressing unit 40 arranged sequentially in a single line to accelerate the process of coating a substrate 50.

Coating Unit 20

Re-referring to FIGS. 1-8, the coating unit 20 may include a knife 22(*a*) or knife 22(*b*) (alternatively referred to as knife 22) and a coating roller 24. In one implementation, the knife 22 may be mounted at an adjustable distance above the coating roller 24, wherein the distance between knife 22 and the coating roller 24 may be adjusted using a dial gauge (not shown in the drawings). The coating roller 24 may be preferably made of hard-chrome platted mild steel. In an alternate embodiment, the coating unit 20 may be provided with a holding member for holding the mounted knives 22. The holding member may be vertical blocks 26 provided with a knife holder 28 to achieve said purpose. In one given embodiment, the vertical blocks 26 with knife holder 28 may enable mounting of knife 22 therein and rotating said knife 22 at desired angle while coating the substrate 50.

The preferred embodiments of the disclosed subject matter may involve two kinds of set up for different kind of knife engaged for different application. The first set up may be for knife 22(*a*) (see FIG. 3) that may be operable in a coating environment requiring filling the pores of the underlying substrate, henceforth referred to as a knife on air application. The alternate set up may be for knife 22(*b*) that may be operable in a coating environment requiring applying a film on the underlying substrate 50, henceforth referred to as a knife on roll application. The knives 22(*a*) and 22(*b*) may involve specific kind of blades for knife on air and knife on roll applications, respectively.

Figure 3:
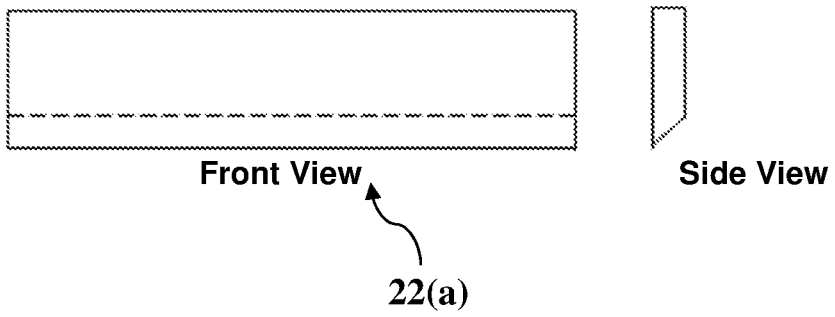
FIG. 3 shows a front view and a side view of blade used for knife on air application, in accordance with an embodiment of the present disclosure.

As shown in FIG. 3, the blade for knife on air application may possess sharp edge at the bottom. During coating application, the knife 22(*a*) may be kept vertical, and preferably away from the coating roller 24. Also shown in FIG. 5 and FIG. 7, the knife 22(*a*) may be held in air so as to fill the pores of the substrate 50 with the coating formulation. This operation may not add to any thickness to the substrate 50, but may improve its barrier properties and also, increase the weight of the coated composite.

Figure 4:
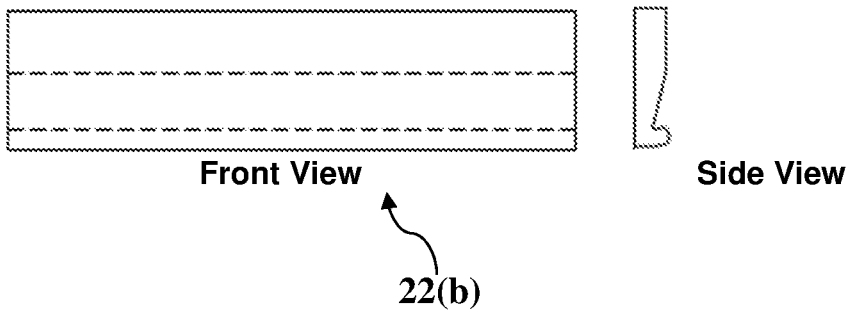
FIG. 4 shows a front view and a side view of blade used for knife on roll application, in accordance with an embodiment of the present disclosure.

Next, FIG. 4 shows the layout of the blade used for knife on roll application. The blade for knife on roll application may have blunt edge which may be kept, for example, at 15° with the vertical during the coating application, also shown in FIG. 6 and FIG. 8. The blade may be fixed just above the coating roller 24 to prepare a film of coating formulation on the substrate 50. This may improve the barrier properties of the substrate 50 and add to the overall weight and thickness of the coated composite.

Vertical blocks 26 may be provided with the knife holder 28 to mount both the knives 22(*a*) and 22(*b*) and allow them to rotate at desired angle. The gap between the knife 22 and coating roller 24 may be smoothly adjusted with the help of dial gauge to control thickness of the coating. The maximum width of the substrate 50 may be limited by the width of coating roller 24 and the knives 22(*a*) and 22(*b*); and a coated composite up to 300 mm width may be prepared by this kind of coating apparatus 10.

Figure 5:
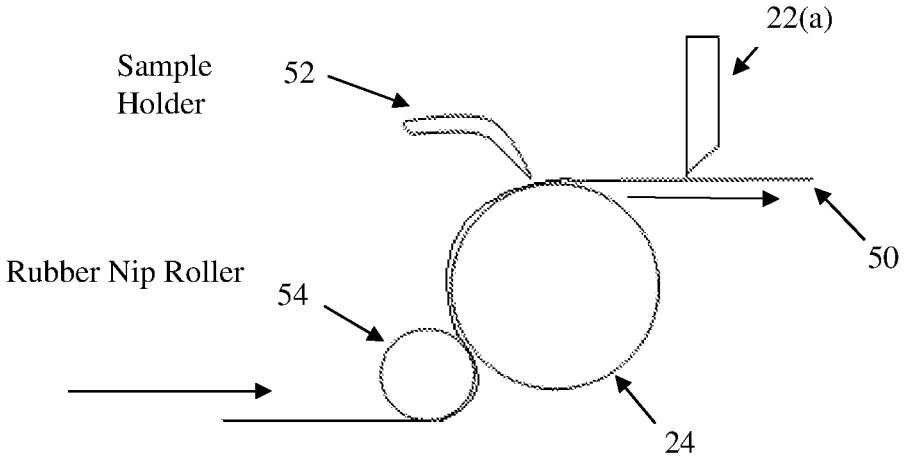
FIG. 5 shows a set-up for knife on air application.
Figure 6:
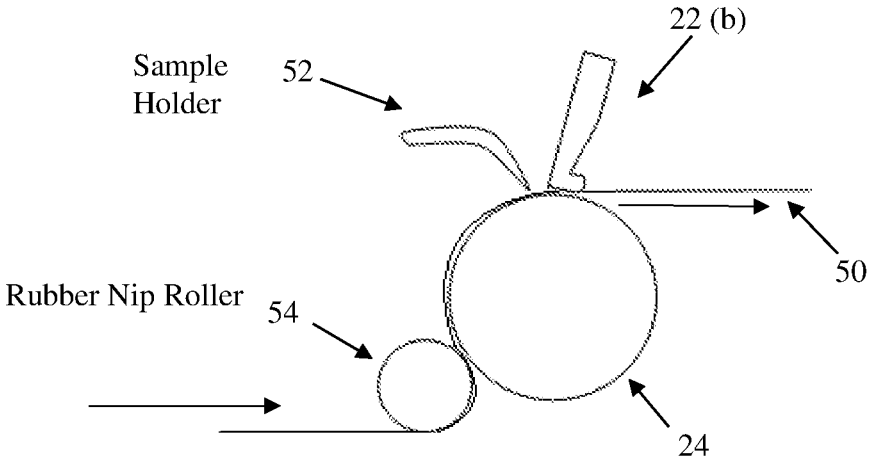
FIG. 6 shows a set-up for knife on roll application.

As can be seen from FIGS. 5 & 6, a pneumatically operated rubber nip roller 54 may be attached just below the coating roller 24 to pull the substrate 50 from an unwind reel. A sample holder 52 may be placed just above the coating roller 24 to keep the coating on the substrate 50. The substrate 50 may be held tightly by the coating roller 24 at one end and the pressing rollers 42(*a*) and 42(*b*) at the other end. Both the rollers can be operated by gearbox and A.C. motor to move the substrate 50 at desired speed in the forward direction to have a uniform coating on the substrate 50.

Drying Unit (30)

The drying unit 30 may be shaped like a rectangular box and may be directly connected downstream to the coating unit 20. Two electric fin type galvanized heaters 32, as shown in FIG. 1, may be used to generate temperature within a range preferably varying from 25° C. to 200° C. inside the dryer. Axial blowers (not shown in the drawings), made of, for example, stainless steel, may be employed to blow hot air through nozzles 36 on top and bottom of the substrate 50. This facility may provide faster drying of the substrate 50 after coating. The insulation panel inside the drying unit 30 may restrict heat loss and maintain uniform temperature throughout the dryer. A "J" type thermocouple may be inserted into the hot air blower section to maintain desired temperature with the help of a temperature controller, installed inside a control panel.

Pressing Unit (40)

The main frame of the pressing unit 40 may be made of, for example, mild steel and connected with cross supports. The pressing unit 40 may include a pair of pressing rolls, a first pressing roll 42(*a*) and a second pressing roll 42(*b*), wherein a first pressing roll 42(*a*) is coated with hard chrome plating (diameter 87 mm) and fixed inside the frame of the pressing unit 40. It can be rotated by gearbox and A.C. motor, attached onto the frame. The second pressing roll 42(*b*) may be pneumatically operated and coated with rubber; preferably with diameter 75 mm. The second pressing roll 42(*b*) may be installed over the first pressing roll 42(*a*). A pressure gauge along with a regulator may be used to maintain desired pressure (up to 7 kg-f/cm$^2$) on the coated substrate 50.

Control Unit

The control panel may be fabricated out of M.S. sheet and coated with powder. It may include an A.C. variable drive for adjusting the speed of coating roller 24 and the pair of pressing rolls 42(*a*) and 42(*b*) with necessary switch gears. The temperature controller for the dryer and controller for the axial blowers may be also installed inside the control panel.

Operating Environment

In one implementation, a method for applying coating upon an underlying substrate 50 utilizing the coating apparatus 10 is disclosed. The substrate 50 may be first cleaned thoroughly before applying coating thereon to remove dirt, grease or any other contaminants on its surface since the untreated substrate 50 may yield poor bonding between the substrate and the coating. The pretreated substrate 50 may be then made to undergo the coating process on a single coating line.

In one general implementation, the substrate 50 may be made to pass through the gap between rubber nip roller 54 and coating roller 24 with knife 22 over its surface, in the coating unit 20. Next, in the drying unit 30 the substrate may pass between top and bottom nozzles 36. Finally, in the pressing unit 40, the substrate may be made to pass between hard chrome platted first pressing roll 42(*a*) and rubber coated second pressing roll 42(*b*).

Figure 7:
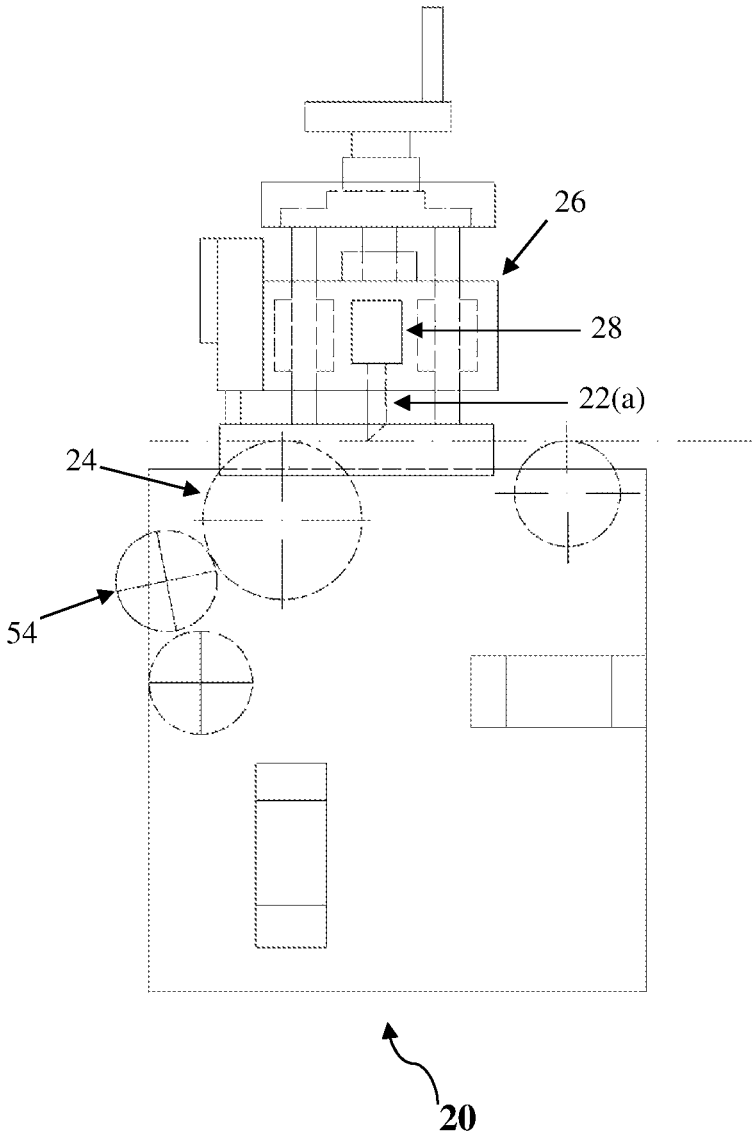
FIG. 7 shows a side view of the coating unit for knife on air application, in accordance with an embodiment of the present disclosure.
Figure 8:
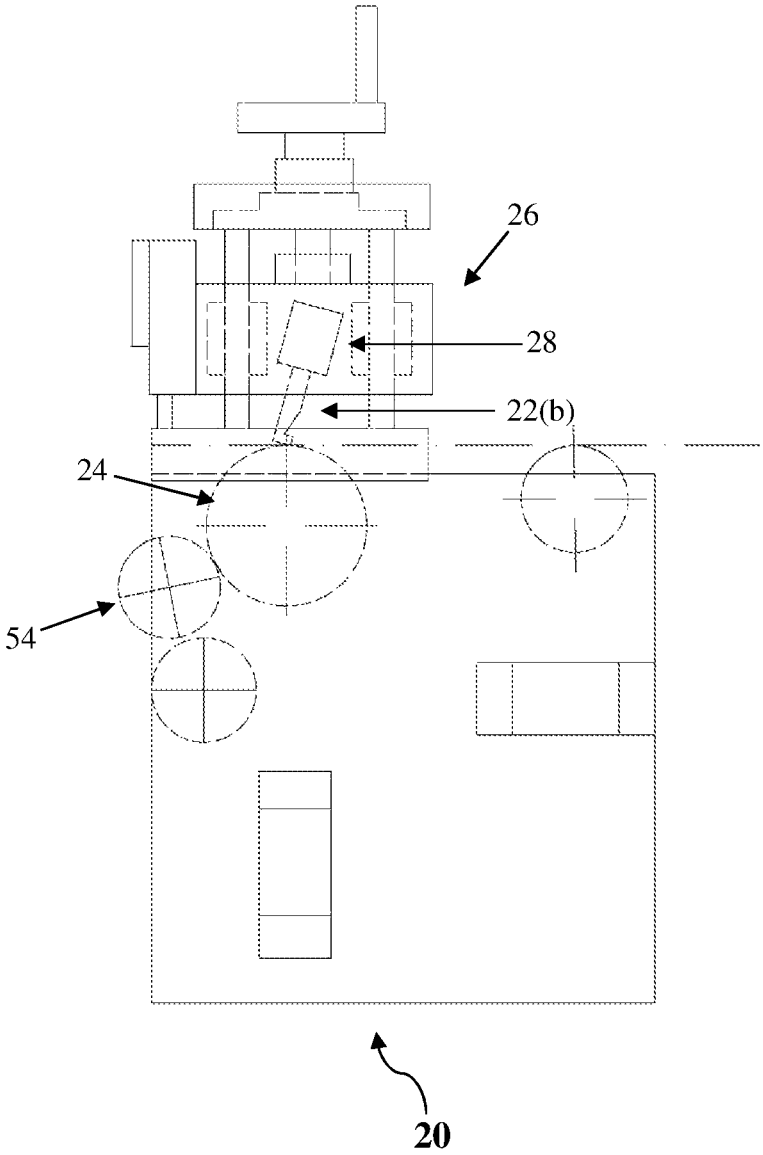
FIG. 8 shows a side view of the coating unit for knife on roll application, in accordance with an embodiment of the present disclosure.

The substrate 50 may be mounted tightly with the coating roller 24 and the pair of pressing rolls 42(*a*) and 42(*b*). The angle of the knife 22, and the gap between the knife 22 and coating roller 24 can be variably adjusted using a dial gauge. It may be noted that in an exemplary knife on air application, the blade should preferably be kept vertical and placed away from the coating roller 24 (FIG. 5 and FIG. 7). The lower edge of the blade should preferably be kept just below the plane of the substrate 50. In an exemplary knife on roll application, the blade should preferably be kept at 15° with the vertical and it should preferably lie just above the coating roller 24 (FIG. 6 and FIG. 8).

Next, the pressure on the pair of pressing roll 42(*a*) and 42(*b*) may be set depending on the application requirement. The speed of the coating roller 24 and the pair of pressing roll 42(*a*) and 42(*b*) may be set after that. Preferably, maintaining the speed of the pair of pressing roll 42(*a*) and 42(*b*) higher than that of the coating roller 24 ensures that the substrate 50 is at tension in the coating line throughout the coating operation.

The drying/curing temperature inside the drying unit 30 can then be fixed with the temperature controller inside the control panel. The hot air blower, however, should not be put on at that time.

The coating apparatus 10 is now ready for coating development on the substrate 50. The coating formulation may be fed to the substrate sample holder 52 followed by rotation of the rolls in the forward direction. As a result, the substrate 50 may be moved in the forward direction resulting into the formation of coating of desired thickness on the substrate 50. The coated composite may then be sent inside the drying unit 30 and the hot air blower may be switched on. The hot air blow from top and bottom of the substrate 50 ensures faster drying of the coated composite. Finally, the hot composite may be pressed using pressing rolls 42(*a*) and 42(*b*). For pasting a metallized film on the substrate 50, the film may be passed along with the coated composite through the pair of pressing roll 42(*a*) and 42(*b*).

The embodiments of the present disclosure may be used for preparing uniform coating of pastes, resins, silicones, adhesives, inks, polymers etc. on different types of substrates like textile fabric, cloth, paper etc. Significantly, the instrument may be useful in preparing coated composites at laboratory scale or industrial scale. The disclosed coating apparatus may produce coated substrate in a single batch process, with sufficient control over each portion of the apparatus. The same coating line may be further used for laminating different sheets of material.

It is intended that the disclosure and examples be considered as exemplary only, with a true scope and spirit of disclosed embodiments being indicated by the following claims.

We claim:

1. A point-of-use coating apparatus comprising:

a coating unit, wherein the coating unit comprises a coating roller and a knife to apply coating onto a substrate, wherein the knife further comprises:

a sharp edged blade and a blunt edged blade which are selectable based on the type of coating application, wherein the coating unit is configured to provide:

a knife on air coating application wherein the sharp edged blade is used for filling the pores of the substrate; and a knife on roll coating application wherein the blunt edged blade is used for applying a film on the surface of the substrate;

a drying unit placed downstream with respect to the coating unit, wherein the drying unit comprises an insulated chamber for drying the coating applied on the substrate;

a pressing unit placed downstream with respect to the drying unit, wherein the pressing unit comprises a pair of pressing rolls configured to press the substrate; and a control unit for controlling operations of the coating unit, drying unit, and the pressing unit.

2. The point-of-use apparatus of claim 1, wherein the coating unit, the drying unit, and the pressing unit are sequentially positioned.

3. The point-of-use coating apparatus of claim 1, wherein a rubber nip roller is disposed below the coating roller to pull the substrate from an unwind reel.

4. The point-of-use coating apparatus of claim 1, wherein a sample holder is arranged to be held above the coating roller to keep the coating on the substrate.

5. The point-of-use coating apparatus of claim 1, wherein the coating roller is made of mild steel with a layer of hard chrome plating.

6. The point-of-use coating apparatus of claim 1, wherein the sharp edged blade is arranged vertically above the coating roller at an adjustable distance.

7. The point-of-use coating apparatus of claim 1, wherein the blunt edged blade is arranged vertically above the coating roller at an adjustable angle with respect to the coating roller.

8. The point-of-use coating apparatus of claim 1, wherein the insulated chamber comprises a galvanized heater and a thermocouple, wherein the galvanized heater and the thermocouple are configured to maintain a temperature range within 25° C. to 200° C.

9. The point-of-use coating apparatus of claim 1, wherein the drying unit further comprises at least one hot air blower positioned axially to the drying unit for blowing hot air on top and bottom of the substrate.

10. The point-of-use coating apparatus of claim 9, wherein a control panel is configured to regulate rolling speed of the coating roller and the pair of pressing rolls, and, temperatures of the drying unit and the at least one hot air blower.

11. The point-of-use coating apparatus of claim 1, wherein a first pressing roll from the pair of pressing rolls is coated with hard chrome plating and a second pressing roll from the pair of pressing roll is coated with rubber.

12. The point-of-use coating apparatus of claim 11, wherein the second pressing roll is installed over the first pressing roll.

13. The point-of-use coating apparatus of claim 1, wherein the pair of pressing rolls are provided with a pressure gauge along with a regulator to maintain a binding pressure on the substrate with the coating.

14. The point-of-use coating apparatus of claim 13, wherein the pressure is maintained approximately up to 7 kg-f/$cm^2$.

15. The point-of-use coating apparatus of claim 1, wherein a dial gauge is used to adjust a distance between the knife and the coating roller.

* * * * *